United States Patent [19]

Knauer et al.

[11] Patent Number: 4,858,433

[45] Date of Patent: Aug. 22, 1989

[54] PILOT BURNER FOR AN APPARATUS FOR BURNING OFF SOLID PARTICLES IN THE EXHAUST GAS OF INTERNAL COMBUSTION ENGINES

[75] Inventors: Alfred Knauer, Stuttgart; Rolf Leonhard, Schwieberdingen; Ulrich Projahn, Ditzingen; Wolfgang Stolper, Fellbach, all of Fed. Rep. of Germany

[73] Assignee: Robert Bosch GmbH, Stuttgart, Fed. Rep. of Germany

[21] Appl. No.: 236,973

[22] Filed: Aug. 26, 1988

[30] Foreign Application Priority Data

Sep. 26, 1987 [DE] Fed. Rep. of Germany ..... 3732492

[51] Int. Cl.[4] ..... F01N 3/26

[52] U.S. Cl. ..... 60/303

[58] Field of Search ..... 60/303; 431/258, 260, 431/262, 347

[56] References Cited

U.S. PATENT DOCUMENTS 4,672,808 6/1987 Leonhard ..... 60/286

4,716,725 1/1988 Dettling .

FOREIGN PATENT DOCUMENTS 1551725 12/1972 Fed. Rep. of Germany .

*Primary Examiner*—Douglas Hart

*Attorney, Agent, or Firm*—Edwin E. Greigg

[57] ABSTRACT

A pilot burner for a device for burning off solid particles, especially soot particles, in the exhaust gas of internal combustion engines has a hollow-cylindrical mixture preparation chamber receiving a glow element and extending eccentrically thereto a hollow-cylindrical glow plug receiving chamber. The two chambers communicate with one another via an opening formed by piercing the chamber walls. A fuel inflow line discharges in the receiving chamber and an air supply line discharges into the preparation chamber. To improve the mixture preparation and largely avoid carbonization of the glow plug, the air supply line discharges into two inflow openings having a tangential direction; one inflow opening is located opposite the opening between the two chambers, and the other inflow opening is located near the end face of the preparation chamber having a mixture outlet opening. In obth inflow openings, the combustion air is introduced in the same direction.

18 Claims, 3 Drawing Sheets

PILOT BURNER FOR AN APPARATUS FOR BURNING OFF SOLID PARTICLES IN THE EXHAUST GAS OF INTERNAL COMBUSTION ENGINES

BACKGROUND OF THE INVENTION

The invention relates to a pilot burner for a device for burning off solid particles, in particular soot particles, in the exhaust gas of internal combustion engines of the type defined hereinafter.

Burnoff devices of this kind are used in particular in motor vehicles having Diesel engines, for the direct disposal of the soot filtered out of the exhaust gas by electrostatic soot traps. Along with a secondary flow of exhaust gas that amounts to less than 1% of the total exhaust gas, this soot is delivered to the combustion chamber of the burnoff device, where it is burned at a flame temperature between 550° C. and 1000° C. The combustion products free of toxic substances, and the remaining gases, are expelled via the engine exhaust system. To generate the burnoff flame, a pilot burner, as described for example in German Offenlegungsschrift 36 21 914, is mounted on the combustion chamber of the burnoff device. In this pilot burner, embodied as a swirl burner, liquid fuel and combustion air in metered amounts are swirled in the mixture preparation chamber, and the fuel-air mixture is delivered via the mixture outlet opening to the combustion chamber of the burnoff device, where after ignition it burns off, along with the soot-laden exhaust gas. The ignition is effected by a glow plug, on which the mixture ignites. After heating, the glow element in the mixture preparation chamber takes on the function of stabilizing the flame formation, so that the glow plug can be switched off again and is needed only for the startup or intermittent operation of the burnoff device. The structure of the pilot burner is definitive for the quality of the mixture preparation and for the load on the glow plugs; accommodating the glow plug in a separate receiving chamber keeps it out of range of the flame, which prevents it from being thermally overloaded.

OBJECT AND SUMMARY OF THE INVENTION

The pilot burner according to the invention has the advantage over the prior art that the second air inflow opening, disposed directly opposite the glow plug, substantially improves the preparation of the fuel-air mixture, on the one hand, and on the other hand cools the heating coil of the glow plug to such an extent that carbonization of the heating coil is avoided. This drastically increases the service life, or time in use, of the glow plug.

When the pilot burner is installed with an approximately horizontal alignment of the mixture preparation chamber and a likewise horizontal glow plug receiving chamber, which is disposed eccentrically to and below the mixture preparation chamber transversely to its longitudinal axis, the combustion air flowing in at a tangent through the second air inflow opening effects an improved removal of the fuel from the fuel sum that forms on the bottom of the receiving chamber. This feature also reduces the danger of carbonization, because it improves the mixture preparation.

The improved mixture preparation and the attendant optimization of combustion and reduction of glow plug carbonization are still further increased if the distribution of the total combustion air supplied to the two inflow openings is at a defined ratio, which in an advantageous feature of the invention is attained by installing different throttle cross sections upstream of the inflow openings, or in other words in the line sections leading to the inflow openings.

The cooling of the glow plug connection thread provided in a further feature of the invention markedly increases the long-term durability of the electrical connection cable for supplying current to the glow plug. If, as in a further embodiment of the invention, the cooling is effected by a portion of the combustion air supplied, then pre-heating of the combustion air can additionally be attained.

When in accordance with a further embodiment of the invention the receiving chamber is disposed laterally of the mixture preparation chamber, which in the installed position of the pilot burner is located horizontally, and with a vertical alignment, the formation of a fuel sump is avoided, and at the same time the conditions for a space-saving design of the pilot burner are provided.

Further contributions to a compact design of the pilot burner are made by disposing the annular conduit, through which air flows, and which forms a cooling jacket for the plug connection thread, eccentrically and by the provision of the fuel inflow line connection ends, extending toward the longitudinal axis of the mixture preparation chamber, or of the line sections of the air supply line.

The central bore in the glow element, in a further embodiment of the invention, provides a simple means of attaching the thermal element, at little constructional expense. At the same time, the thermal element, which serves to regulate the temperature in the combustion chamber of the burnoff device, is located in the immediate vicinity of the flame, resulting in short reaction times in the regulation process.

The especially embodied flanges in a further feature of the invention enables problem-free, fast installation of the pilot burner on the burnoff device, and the pilot burner can be installed in any position.

By embodying the burner orifice in front of the mixture outlet opening in various ways, for instance as a nozzle or as a diffusor, the shape of the flame can be varied and adapted to various requirements.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
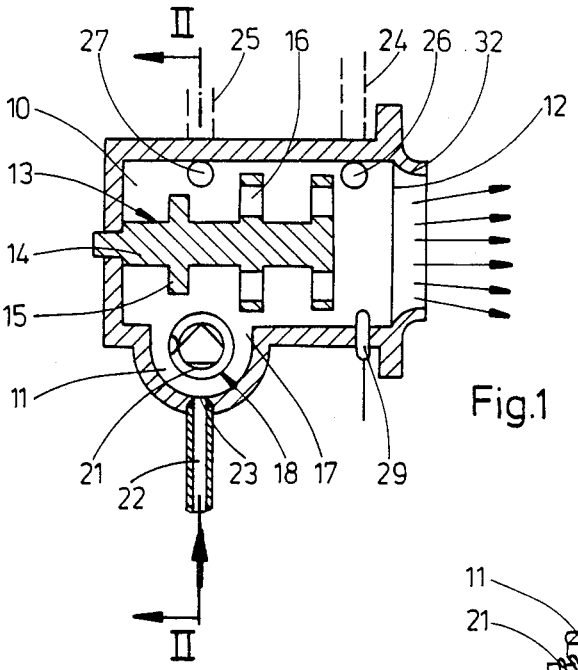
FIG. 1 is a longitudinal section through a pilot burner for a burnoff device.
Figure 2:
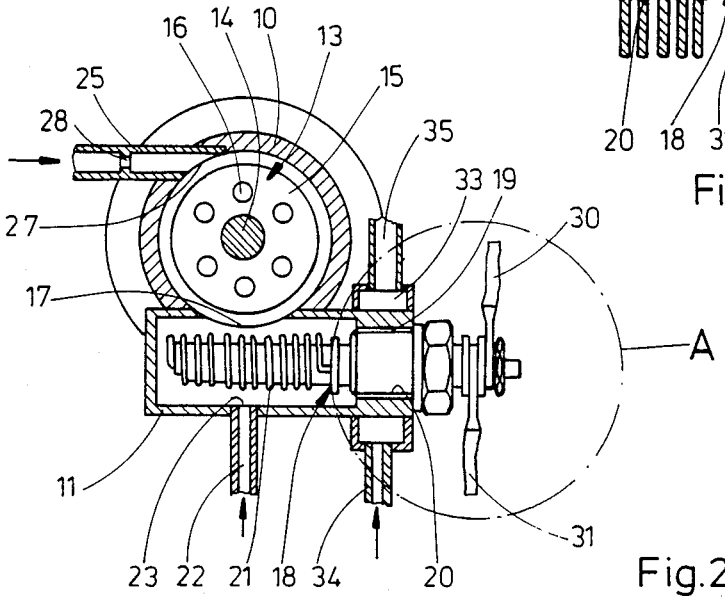
FIG. 2 is a section through the pilot burner taken along the line II—II of FIG. 1.
Figure 4:
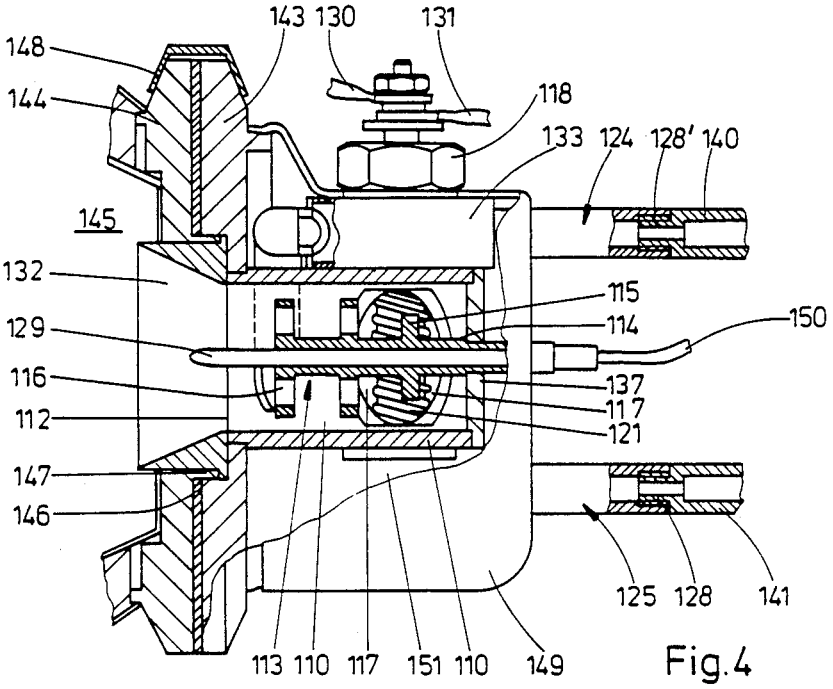
FIG. 4 is a longitudinal section through the pilot burner in a further exemplary embodiment.
Figure 5:
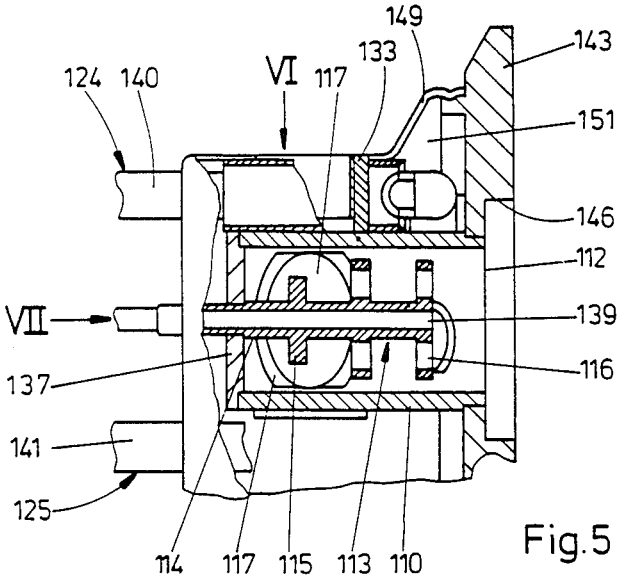
FIG. 5 is a longitudinal section through the pilot burner of FIG. 4 after removal of the glow plug, thermal element and burner orifice.
Figure 6:
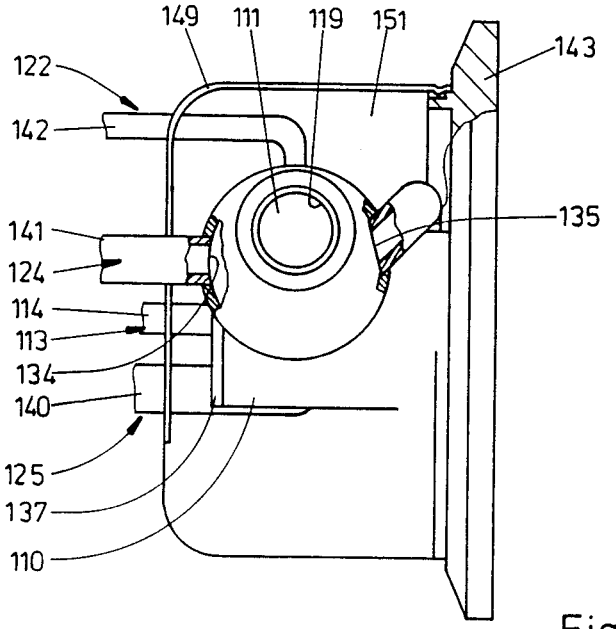
FIG. 6 is a view of the pilot burner in the direction of the arrow VI in FIG. 5.
Figure 7:
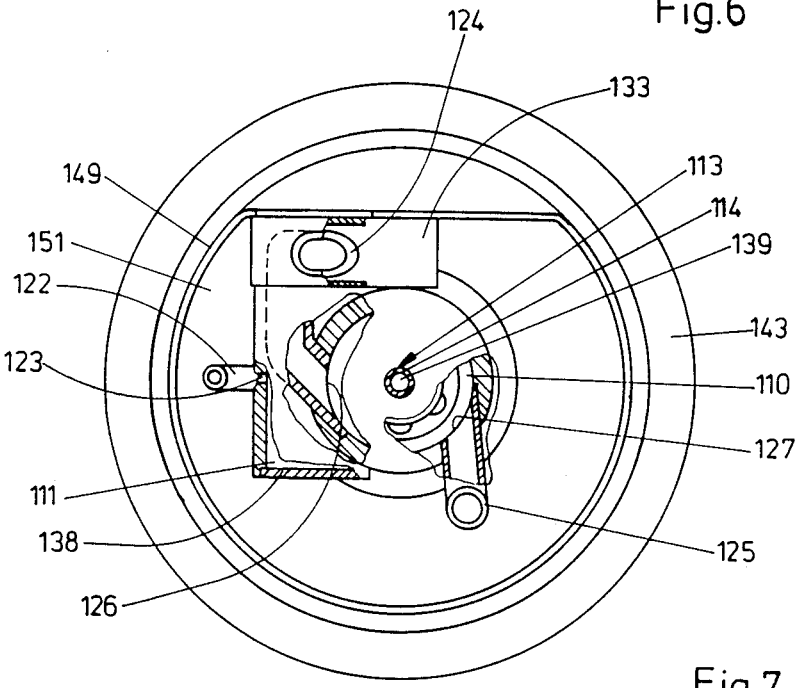
FIG. 7 is a view of the pilot burner in the direction of the arrow VII of FIG. 5.

The pilot burner, shown schematically in longitudinal section in FIG. 1 and in cross section in FIG. 2, for a device for burning off solid particles, in particular soot particles, in the exhaust gas of an internal combustion engine, in particular a Diesel engine, has a hollow-cylindrical mixture preparation chamber 10, and a glow plug receiving chamber 11, extending transversely and eccentrically thereto. The mixture preparation chamber 10, hereinafter denoted simply as the preparation chamber 10, is closed at one face end, and on its other face end has an outlet opening 12 for the mixture of liquid fuel and combustion air prepared in the preparation chamber 10. A glow element 13 is disposed coaxially in the preparation chamber 10 and serves to stabilize the flame. It is secured to the closed end wall of the preparation chamber 10 and extends toward the outlet opening 12. The glow element 13 has a plurality of annular ribs 15, in this case three, protruding radially from a shaft 14, of which the two annular rings 15 near the outlet opening 12 have openings 16 distributed uniformly over the circumference.

In the installed position of the pilot burner, the preparation chamber has an approximately horizontal alignment, as shown in FIGS. 1 and 2. The glow plug receiving chamber 11, hereinafter signified simply as the receiving chamber 11, is located below the preparation chamber 10 and likewise is aligned horizontally. The two chambers 10, 11 communicate with one another via a connecting opening 17 formed by piercing the chamber walls. The receiving chamber 11 is closed at one face end; from the other face end, a glow plug 18 is screwed coaxially into the receiving chamber. To this end, on its face end remote from the closed face end, the receiving chamber 11 has an internally threaded section 19, into which the glow plug 18 is screwed with its connection thread 20. The incandescent coil 21 of the glow plug 18 extends nearly all the way through the receiving chamber 11, ending just before its closed face end. A fuel inflow line 22 discharges into the receiving chamber 11, approximately halfway along its longitudinal extension; the axis of the mouth if the fuel inflow line is aligned approximately radially to the receiving chamber 11. In the installed position shown in FIGS. 1 and 2, the mouth 23 of the fuel inflow line 22 is located on the underside of the receiving chamber 11, below the incandescent coil 21.

The combustion air required for mixture preparation is supplied via an air supply line, which is divided into two sections 24, 25 shown only in dot-dash lines in FIG. 1. In FIG. 2, the line section 25 can be seen in its correct installed position. Each line section 24, 25 discharges into an inflow opening 26, 27 in the wall of the preparation chamber 10. The axes of the inflow openings 26, 27 are aligned at a tangent to the preparation chamber 10, so that the combustion air enters the preparation chamber 10 with a tangential inflow direction. The first inflow opening 26, associated with the line section 24, is disposed near the mixture outlet opening 12, while the second inflow opening 27, associated with the line section 25, is located in the region of the wall of the preparation chamber 10 opposite the connecting opening 17 between the two chambers 10 and 11. The axis of the second inflow opening 27 and the axis of the mouth of the fuel inflow line 22 into the receiving chamber 11, together with the longitudinal axis of the receiving chamber 11, are located in a common plane, which is aligned at right angles to the longitudinal axis of the preparation chamber 10. A throttle 28 is installed in each line section 24, 25; one such throttle 28 is visible in the line section 25 in FIG. 2. By variably dimensioning the throttle cross sections, the ratio of the combustion air flowing into the preparation chamber through the two inflow openings 26 and 27 can be precisely adjusted. A thermal element 29, with which the temperature of the burner flame is measured, also protrudes into the preparation chamber 10 near the mixture outlet opening 12. A regulating device, not shown, assures metering of the fuel and combustion air such that the flame temperature is largely constant. The metering of the fuel and combustion air is effected either via clocked magnetic valves or via controlled pumps.

For starting up the pilot burner, the glow plug 18 is supplied with current. To this end, the coil 21 is connected via electrical connection lines 30, 31 to a source of current. Liquid fuel is directed into the receiving chamber 11 via the fuel inflow line 22, and at the same time combustion air is blown into the preparation chamber 10 via the two inflow openings 26, 27. The tangential inflow of combustion air produces a counterclockwise swirl flow—as seen from the mixture outlet opening 12—which removes the fuel from the fuel sump on the bottom of the receiving chamber 11 and mixes it well with the combustion air. When a predetermined temperature is attained, the fuel-air mixture in the preparation chamber 10 ignites, and the flame propagates through the outlet opening 12 into the combustion chamber, not shown, of the burnoff device. After some time, the glow element 13 attains the ignition temperature, so that the flame formation is stabilized, and the glow plug 18 can be switched off. The outlet opening 12 is encompassed by a burner orifice 32, which is integral with the chamber wall of the preparation chamber 10 and is embodied as a nozzle, which concentrates the ignition flame into the axial direction in such a way that approximately in the middle of the combustion chamber of the burnoff device, a very hot core combustion zone forms, in which the soot particles are quickly brought to the reaction temperature.

To increase the service life of the electrical connection lines 30, 31, the jacket of the receiving chamber 11 is cooled in the vicinity of the internally threaded section 19 that receives the connection thread 20 of the glow plug 18. In the exemplary embodiment of the pilot burner shown in FIGS. 1 and 2, this cooling is effected by an annular conduit 33, which annularly encompasses the internally threaded section 19 and is interpolated with an inlet 34 and an outlet 35 into the supply line. The annular conduit may either be interpolated upstream, in the air flow direction, of the division of the air supply line into the line sections 24 and 25, or it may be located in one of the two line sections 24, 25. The combustion air arriving from the air supply apparatus first flows through the annular conduit 33, then flows via the line sections 24 and 25 into the preparation chamber 10. In the annular conduit 33, the air absorbs heat form the internally threaded section 19 and is thereby heated. The pre-heated combustion air means that less energy is required for igniting the fuel-air mixture.

Figure 3:
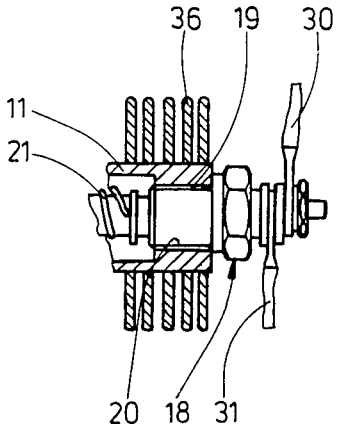
FIG. 3 shows a modification in the area marked A in FIG. 1.

In the exemplary embodiment of the pilot burner shown in a detail in FIG. 3, the cooling of the receiving chamber 11 in the vicinity of the plug connection thread 20 or internally threaded section 19 is effected by ribs 36, disposed on the jacket of the receiving chamber 11 transversely to its longitudinal axis. The ribs 36 may, however, extend axially instead.

In the exemplary embodiment of a pilot burner shown in various views in FIGS. 4–7, components identical to those in the pilot burner of FIGS. 1 and 2 are identified by the same reference numerals, but raised by 100 for the sake of distinguishing them. Once again, a mixture preparation chamber 110 and a glow plug receiving chamber 111 are provided. The two chambers are again hollow-cylindrical and disposed transversely and eccentrically to one another. They communicate with one another via a connecting opening 117, formed by piercing the chamber walls of both chambers 110 and 111. Each chamber 110, 111 is closed at one face end by a cap 137 and 137, respectively. The other face end of the preparation chamber 110 again has the outlet opening 112 for the mixture, while the other face end of the receiving chamber 111 is again sealed off by the connection thread of the glow plug 118 (not shown), which extends with its coil 122 to near the cap 138 and is connected, at its end protruding out of the receiving chamber 111, to the electrical connection lines 130 and 131. The glow plug 118 is disposed coaxially in the receiving chamber 111, and the glow element 113 is likewise coaxially aligned in the preparation chamber 110. The glow element 113 is secured with its shaft 114 in the cap 137 and extends to near the outlet opening 112. It has similar transversely disposed ribs 115, which are provided with openings 116. The shaft 114 has a longitudinal continuous central axial bore 139 (see FIG. 5), through which the thermal element 129 is passed, in such a way that the thermal element projects outward at the free end of the glow element 113 to a position which is beyond the outlet opening 112.

In contrast to the pilot burner of FIGS. 1 and 2, the receiving chamber 111 is located laterally of the preparation chamber 110, which in the installed position of the pilot burner is again approximately horizontally aligned, so that the receiving chamber has a vertical alignment, and the glow plug 118 likewise extends approximately vertically. Once again, the fuel inflow line 122 discharges into the receiving chamber 111 with the axis of its mouth being radial with respect to the receiving chamber 111; the mouth 123 is located about halfway up the height of the receiving chamber 111. The air supply line, once again divided into two line sections 124 and 125, discharges into the preparation chamber 110 in the same manner as described in conjunction with FIGS. 1 and 2. Both inflow openings 126, 127 of the line sections 124, 125 have a tangential inflow direction and are disposed such that, from the standpoint of the outlet opening 112, a clockwise swirl flow of the air is created. The inflow opening 126 is again disposed in the vicinity of the outlet opening 112, while the inflow opening 127 is located directly opposite the connecting opening 117 between the preparation chamber 110 and the receiving chamber 111. Throttles 128 and 128′ are provided in the line sections 124 and 125, the throttle cross sections of which are dimensioned such that the quantities of air that flow into the preparation chamber 110 through the inflow openings 126 and 127 are at a correct ratio for optimal mixture preparation. To attain a compact design, the connection ends 140 and 141 of the line sections 124 and 125, like the connection end 142 of the fuel inflow line 122, are located parallel to the longitudinal axis of the preparation chamber 110.

The glow plug 118 is again cooled in the vicinity of its connection thread. To this end, the region in which the glow plug 118 is screwed into the receiving chamber 11 is encompassed by an annular conduit 133, which here, to make for a more compact structure, is disposed eccentrically to the receiving chamber 111. The annular conduit 133 is interpolated into the line section 124, so that the combustion air flowing through the throttle cross section 128′ heats up in the annular conduit 133, and the heated combustion air flows via the first inflow opening 126 into the preparation chamber 110 near the mixture outlet opening 112.

On its face end having the outlet opening 112, the preparation chamber 110 has a fastening flange 143, welded to the chamber wall of the hollow-cylindrical preparation chamber 110. The fastening flange 143 corresponds to a mounting flange 144, which is firmly connected to the combustion chamber, suggested at 145, of the burnoff device. The fastening flange 143 has a centering recess 146, and the mounting flange 144 has an axially protruding centering ring 147 corresponding with the recess 146. Once the face end of the fastening flange 143 is placed on the face end of the mounting flange 144, the two flanges are clamped together at the circumference by means of a clamping collar 148. This fastening device embodied by the flanges 143 and 144 and the clamping collar 148 makes it possible for the pilot burner to be mounted on the burnoff device in any arbitrary rotational position of the pilot burner relative to the combustion chamber 145, and vice versa.

The preparation chamber 110 and receiving chamber 111 are surrounded by a protective hood 149, which engages the fastening flange 143. The glow plug 118, the fuel inflow line 122, the line sections 124 and 125 of the air supply line, and the electrical connecting cable 150 to the thermal element 129 are all passed through the protective hood 149. The hollow space 151 remaining in the protective hood 149 is either filled with insulating material or is embodied as a heat exchanger, for further heating of the combustion air. In the latter case, the protective hood 149 must be welded in a gas-tight manner, to avoid major losses of combustion air.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pilot burner for a device for burning off soot particles, in the exhaust gas of internal combustion engines, comprising a hollow-cylindrical mixture preparation chamber that coaxially receives a glow element and is closed on one face end and on the other face end has a mixture outlet opening, a hollow-cylindrical receiving chamber extending transversely of and eccentrically to the mixture preparation chamber arranged to receive a glow plug, said receiving chamber being closed on both face ends and adapted to communicate with the mixture preparation chamber via an opening formed by piercing the chamber walls of both chambers, a fuel inflow line discharging into the receiving chamber, an air supply line arranged to discharge into the mixture preparation chamber, the air supply line having at least one inflow opening disposed near the mixture outlet opening and having a tangential inflow direction, said air supply line (24, 25; 124, 125) having at least one second inflow opening (27; 127), which is disposed in the region of the wall of the mixture preparation chamber (10; 110) opposite the opening (17; 117) which adjoins the mixture preparation chamber (10; 110) and the receiving chamber (11; 111) and said air inflow having a tangential inflow direction in the same direction as the first inflow opening (26; 126).

2. A pilot burner as defined by claim 1, in which the second inflow opening (27; 127) and the receiving chamber (11; 111) having axes which are located in a common plane at right angles to the longitudinal axis of the mixture preparation chamber (10; 110).

3. A pilot burner as defined by claim 2, in which the mouth (23; 123) of the fuel inflow line (22; 122) has an axis which is located in the same plane and is preferably aligned radially relative to the receiving chamber (11; 111).

4. A pilot burner as defined by claim 1, in which the air supply line (24, 25; 124, 125) include throttles (28; 128, 128') which are associated with the inflow openings (26, 27; 126, 127) and further adapted to have variously adjustable throttle cross sections.

5. A pilot burner as defined by claim 1, in which the receiving chamber (11; 111), at said one face end, has an internally threaded section (19) for receipt of the glow plug (18; 118), and further that the jacket of the receiving chamber (11; 111) is cooled in the vicinity of the internally threaded section (19).

6. A pilot burner as defined by claim 1, in which the receiving chamber (11), is aligned approximately horizontally relative to the preparation chamber (10) and is disposed therebelow.

7. A pilot burner as defined by claim 5, in which the receiving chamber (11) is provided with a jacket having cooling ribs (36) which protrude at right angles in the vicinity of the internally threaded section (19).

8. A pilot burner as defined by claim 1, in which the receiving chamber (111), is aligned approximately horizontally relative to the mixture preparation chamber (110) and disposed laterally thereof.

9. A pilot burner as defined by claim 5, in which the receiving chamber (11; 111) has a jacket which is surrounded in the vicinity of the internally threaded section (19; 119), by an annular conduit (33; 133) and the inlets and outlets (34, 35; 134, 135) thereof are disposed in the air supply line (24, 25; 124, 125).

10. A pilot burner as defined by claim 9, in which the annular conduit (133) is disposed eccentrically relative to the receiving chamber (111), and is disposed in the section (124) of the air supply line which leads to inflow opening (126).

11. A pilot burner as defined by claim 1, in which the glow element (113) has an axial bore (139) adapted to receive a thermal element (129).

12. A pilot burner as defined by claim 1, in which the mixture outlet opening (12; 112), further includes an orifice which is embodied as a nozzle having a cross section that tapers conically toward the free end.

13. A pilot burner as defined by claim 1, in which the face end of the mixture outlet opening (112), adjoins a fastening flange (143), which is complemental to a mounting flange (144) disposed on the combustion chamber (145) of the burnoff device and said respective flanges adapted to be connected by means of a clamping collar (148).

14. A pilot burner as defined by claim 13, in which the fastening flange (143) has a recess (146), coaxial with the mixture outlet opening (112), adapted to receive the burner orifice (132).

15. A pilot burner as defined by claim 1, in which the mixture preparation chamber (110) and the receiving chamber (111) are encompassed by a protective hood (149) that exposes the glow plug connection and the mixture preparation opening (112).

16. A pilot burner as defined by claim 15, in which the chambers (110, 111) are filled within the protective hood (149) with insulating material.

17. A pilot burner as defined by claim 15, in which the chambers (110, 111), are enshrouded by a protective hood and air flow therethrough is adapted to pre-heat combustion air.

18. A pilot burner as defined by claim 1, in which the fuel inflow line (122) and the line sections (124, 125) as well as the connection ends (142, 140, 141) extend parallel to the longitudinal axis of the mixture preparation chamber (110).

* * * * *